US006938972B2

(12) United States Patent
Booth et al.

(10) Patent No.: US 6,938,972 B2
(45) Date of Patent: Sep. 6, 2005

(54) METHOD AND APPARATUS FOR INCREASING INKJET PRINTING SPEED

(75) Inventors: Andrew J. S. Booth, Qualicum Beach (CA); Carl A. Voth, Surrey (CA); Daniel Gelbart, Vancouver (CA)

(73) Assignee: Creo SRL, Burnaby (CA)

( * ) Notice: Subject to any disclaimer, the term of this patent is extended or adjusted under 35 U.S.C. 154(b) by 134 days.

(21) Appl. No.: 10/667,412

(22) Filed: Sep. 23, 2003

(65) Prior Publication Data

US 2004/0113964 A1 Jun. 17, 2004

Related U.S. Application Data

(60) Provisional application No. 60/413,574, filed on Sep. 26, 2002.

(51) Int. Cl.[7] ..... B41J 29/38; B41J 11/46

(52) U.S. Cl. ..... 347/14; 347/19; 400/583.4

(58) Field of Search ..... 347/14, 19, 104, 347/105, 37, 153, 154; 400/583.4, 611

(56) References Cited

U.S. PATENT DOCUMENTS 5,459,502 A * 10/1995 Sakaki et al. ..... 347/100
6,742,859 B2 * 6/2004 Yonekubo et al. ..... 347/27

* cited by examiner

*Primary Examiner*—Lamson Nguyen
(74) *Attorney, Agent, or Firm*—Oyen Wiggs Green & Mutala

(57) ABSTRACT

In an inkjet printer there is a trade off between speed and quality. Higher speed can be achieved at the expense of quality as inkjet droplets deposited are distorted in shape and or placement position if the relative velocity between the inkjet nozzles and the printing medium is simply increased. The velocity above which distortion occurs is termed threshold velocity. A feed mechanism that varies the printing medium advance rate to allow printing at below threshold velocity while maintaining a high average feed rate is described. By advancing the printing medium at a periodically varying velocity, with the printing medium velocity lower than the threshold velocity, the problem is avoided.

19 Claims, 4 Drawing Sheets

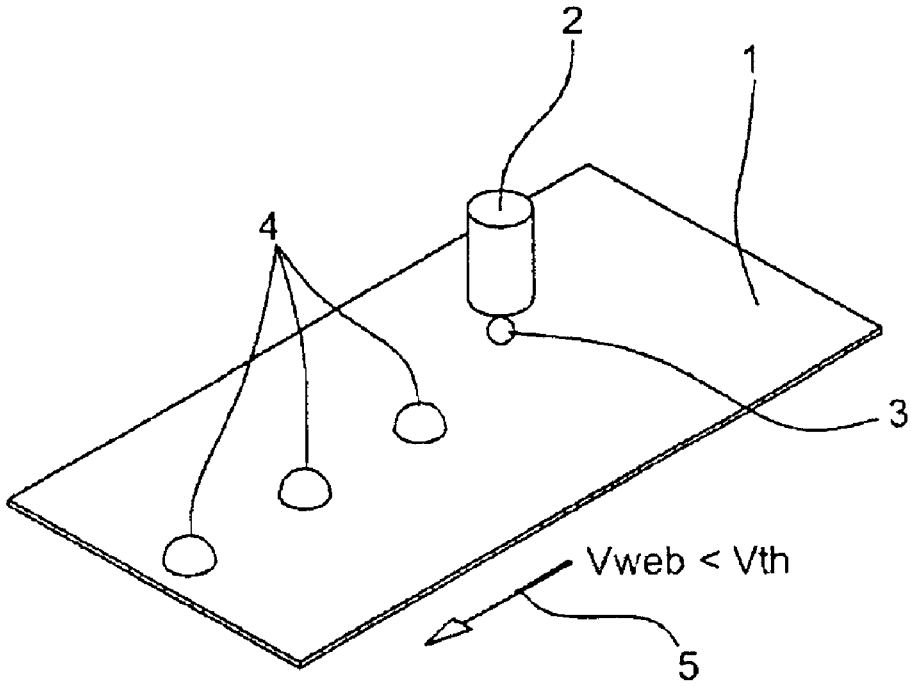
FIG. 1-A
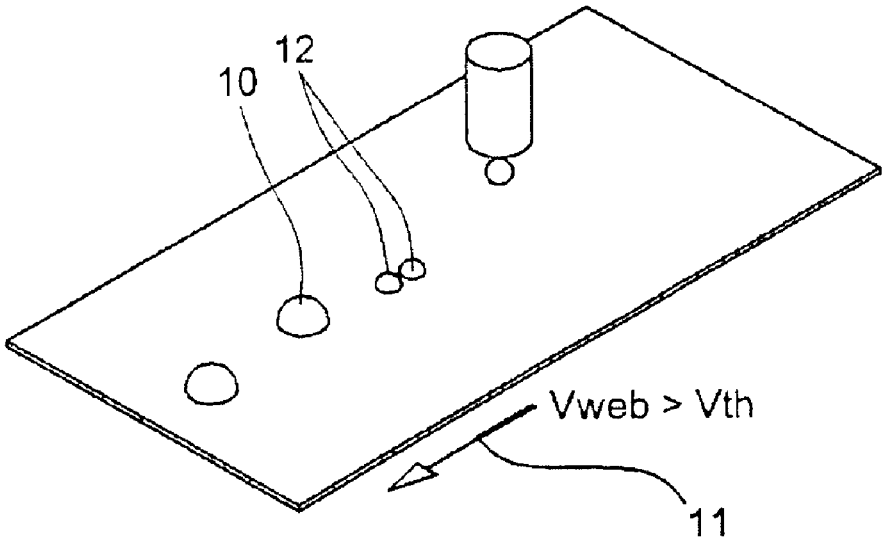
FIG. 1-B

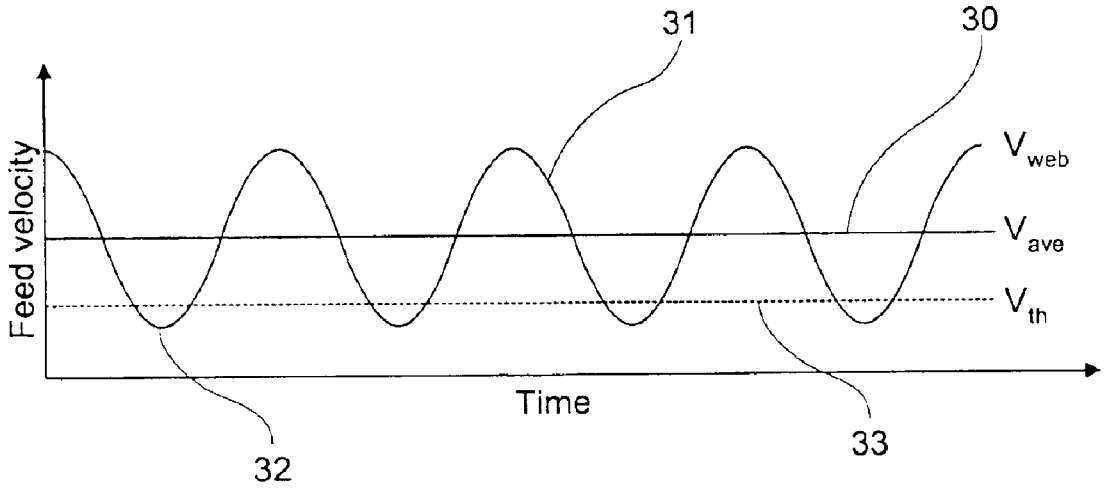
FIG. 3-A
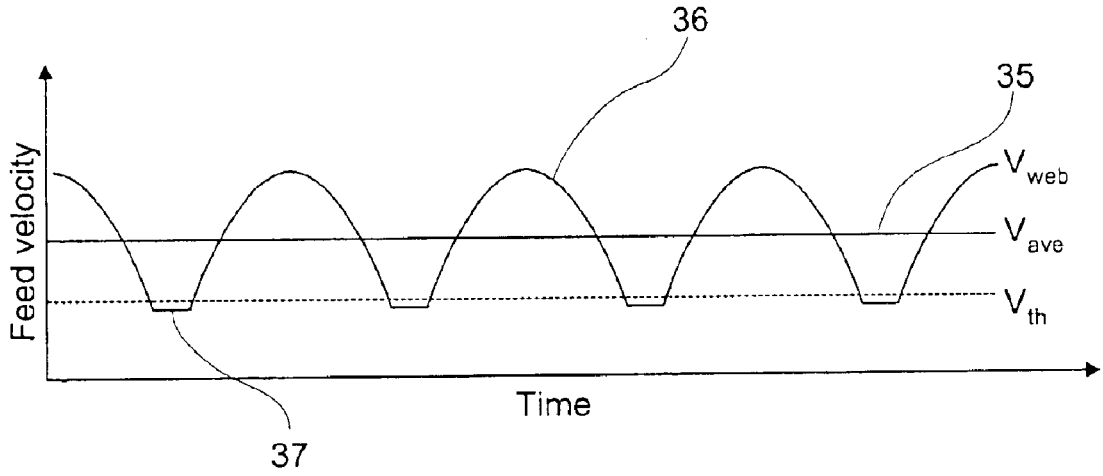
FIG. 3-B

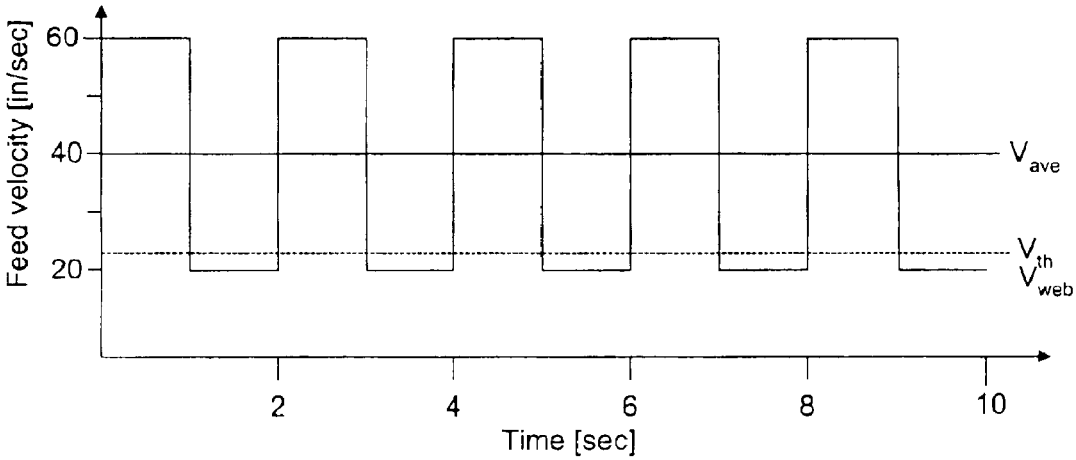
FIG. 4-A
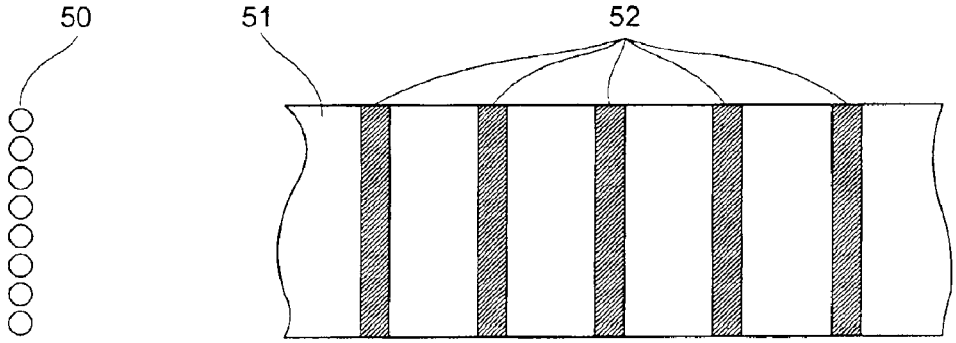
FIG. 4-B
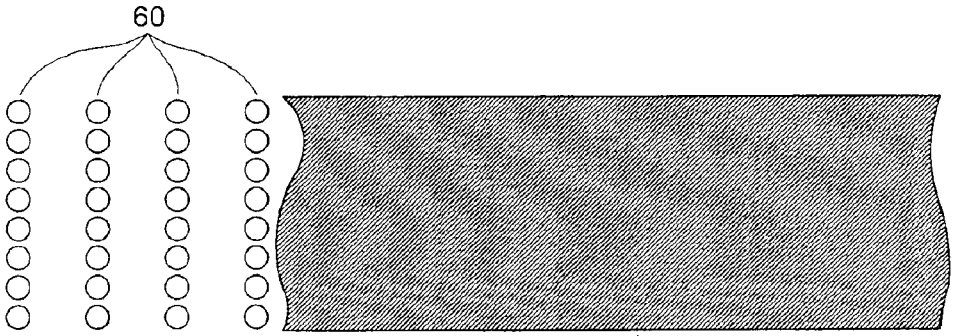
FIG. 4-C

METHOD AND APPARATUS FOR INCREASING INKJET PRINTING SPEED

REFERENCE TO RELATED APPLICATION

This application claims the benefit of the filing date of U.S. application Ser. No. 60/413,574 filed on 26 Sep. 2002.

TECHNICAL FIELD

This invention relates to the field of printing, and more particularly to the field of printing using inkjet print nozzles.

BACKGROUND

Inkjet printers have gained wide acceptance as desktop printing devices and are set to rival other conventional printing techniques as the quality and speed of the inkjet printing process have improved. An inkjet printer forms an image by printing a pattern of individual dots at particular locations of a grid defined for the printing medium. Inkjet printers print the dots by ejecting very small drops of ink onto a printing medium. The printing medium is typically fed past the inkjet printhead in an indexed motion. The printhead is typically located on a movable carriage that supports one or more printheads each having ink ejecting nozzles. The carriage traverses over the surface of the printing medium, and the nozzles eject drops of ink at appropriate times according to image data provided by a controller. In each traverse of the printhead carriage a swath is printed, followed by an indexing of the printing medium feed.

In extending inkjet printing beyond the desktop printing market, a key limitation has been printing speed. While it is acceptable to have a printing device with productivity in the region of a few pages per minute for personal use, productivity of commercial printing devices must be far greater.

The need to traverse the printhead across the printing medium can be largely or altogether avoided if sufficient nozzles are provided to cover the width of the page. Known as a "page wide array", such devices with a multiplicity of addressable inkjet nozzles may be used to enable an entire page to be printed in a single pass.

There remains a need for techniques that increase the speed of inkjet printing and in particular, there is a need for high productivity inkjet-based printing devices.

SUMMARY OF INVENTION

A first aspect of the invention provides a method for printing using one or more inkjet nozzles while feeding a printing medium past one or more inkjet nozzles at a varying relative velocity. The relative velocity alternates between a first velocity higher than a threshold velocity and a second velocity lower than the threshold velocity. The inkjet nozzles are selectively activated in response to data supplied by a controller only while the relative velocity is below the threshold velocity.

Another aspect of the invention provides an inkjet printing apparatus having one or more inkjet printing nozzles disposed to eject ink droplets onto a printing medium. The apparatus comprises a feed for advancing the printing medium past the nozzles at a variable relative velocity. The relative velocity alternates between a first velocity, higher than a threshold velocity, and a second velocity, lower than the threshold velocity. A controller selectively activates the nozzles for printing only when the relative velocity is lower than the threshold velocity.

Further aspects of the invention and features of specific embodiments of the invention are described below.

BRIEF DESCRIPTION OF DRAWINGS

In drawings which illustrate by way of example only preferred embodiments of the invention:

FIGS. 1-A and 1-B are depictions of a problem related to inkjet printing at high speeds;

FIGS. 3-A and 3-B are graphs of relative velocity vs. time for an inkjet printer according to an embodiment of the invention;

FIGS. 4-A to 4-C illustrate an example relating to the invention.

DESCRIPTION

Figure 2:
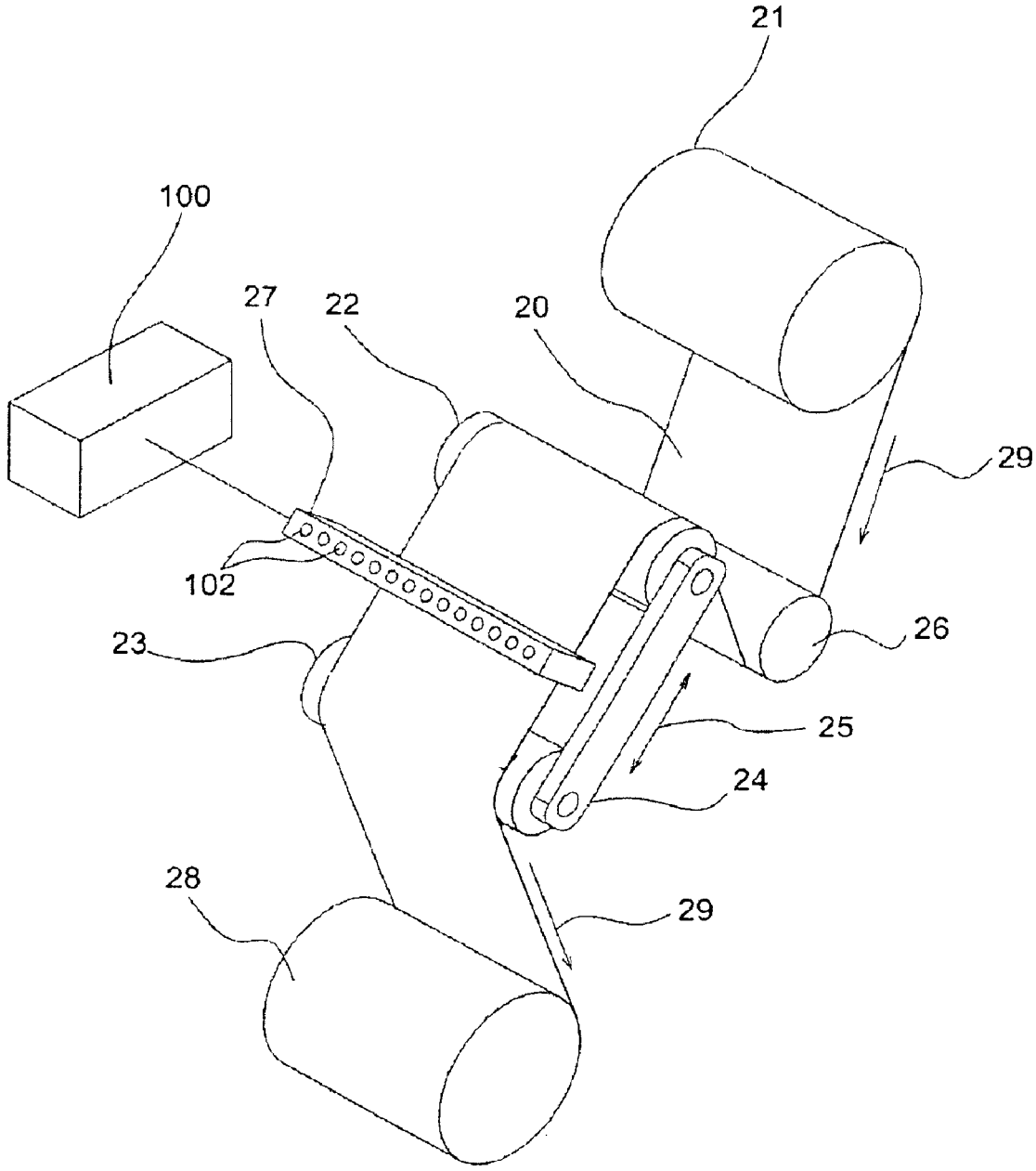
FIG. 2 shows a printer according to an embodiment of the invention.

Throughout the following description, specific details are set forth in order to provide a more thorough understanding of the invention. However, the invention may be practiced without these particulars. In other instances well known elements have not been shown or described in detail to avoid unnecessarily obscuring the invention. Accordingly, the specification and the drawings are to be regarded in an illustrative rather than a restrictive sense.

As inkjet nozzles with higher firing rates become available, a corresponding increase in printing speed is possible but unfortunately other limitations come into play. In taking advantage of the increased firing rate, the printing medium feed rate may be increased, thus resulting in increased productivity. At some point however, increased relative velocity between the nozzle and the printing medium results in reduced quality. At faster printing medium feed rates, the ejected ink droplets deposited on the printing medium can become distorted or misplaced. The feed rate above which print quality becomes unacceptably degraded is known as the threshold velocity, $V_{th}$.

In FIG. 1-A a printing medium 1 is shown with stationary inkjet nozzle 2 directing ink droplet 3 towards printing medium 1. The media is being fed in direction 5 is at velocity $V_{web}$, where $V_{web}$ is less than the threshold velocity ($V_{th}$). The dots 4 formed on printing medium 1 remain substantially undistorted under these conditions. In FIG. 1-B, the printing medium is being fed in direction 11 at a velocity $V_{web}>V_{th}$. Dot 10 has a placement error and dot 12 has been split into a pair of dots. In FIGS. 1-A and 1-B it is the relative velocity between the inkjet nozzle 2 and the printing medium, and not absolute feed velocity $V_{web}$, that is of primary importance in determining whether distortion or other degradation of the dots occurs. In this simplified example, the relative velocity is $V_{web}$ since inkjet nozzle 2 is stationary.

In other situations the velocity of the web $V_{web}$ may not be the same as the relative velocity between the inkjet nozzle and the printing medium, as would occur if the nozzles themselves were moving relative to the rest of the printing machine.

While not wishing to be bound by any particular theory, the mechanism of dot distortion and placement error is thought to be a complex interaction between a number of factors. The factors in play may further depend on the type of nozzle. Discernable differences have been observed between some piezoelectric nozzles and some thermal nozzles.

Some imperfections can be caused by the shapes of ejected ink droplets. Droplets ejected from inkjet nozzles are typically not spherical. For example, a droplet with a teardrop or elongated shape may result in a dot on the printing medium with a tail. At low feed rates, the surface tension of droplets, in combination with the absorption properties of the printing medium, may result in approximately round dots but as the feed rate of the printing medium is increased, the tails may elongate and become more visible.

Some nozzles have been observed to eject pairs of closely spaced droplets (one behind the other) rather than single droplets. In this case, the appearance of dots on the printing medium may change significantly with web feed, the dot separation increasing as the feed is increased.

The droplets for a particular nozzle may also not be uniformly sized and differences may also be expected from nozzle to nozzle. Different size droplets may account for some of the placement errors with other factors such as firing angle, firing speed and timing possibly being significant.

The threshold velocity is a convenient measure but should not be viewed as a hard threshold. Threshold velocity may be determined empirically through inspection of printed samples with some judgement being made as to acceptability. In some instances, such as the example where two closely spaced droplets are ejected, a threshold may occur when at some feed rate double dots become discernable.

In anticipating continuing improvements in inkjet nozzle firing rate, the threshold velocity limitation on feed rate of the printing medium is a barrier to faster inkjet printing. Even if not presently limited by this problem, inkjet architectures may not be able to take advantage of nozzle improvements as they become available.

In general, it is faster to print on a continuous web printer than with sheet-fed printers because continuous web printers do not require repetitive loading and unloading of sheets. This continuous web printer can maintain a faster continuous feed. In offset lithographic printing web presses are typically three to four times faster than similar format sheet-fed presses. In this description and the appended claims, the term "feed" is used to refer to the action or apparatus involved in transporting a printing medium through a printing device. A feed is typically a combination of mechanical and electrical components that cooperate to advance a printing medium through a printing device at a stepwise, constant, or variable rate.

A fast inkjet printer with a continuous web feed can be built using a page wide array of inkjet nozzles. However, the maximum feed rate will be limited by the threshold velocity, eradicating much of the benefit that could otherwise be realized in such a device. This invention varies the relative speed of a printing medium and one or more inkjet nozzles in order to increase the potential throughput of an inkjet printer. The average feed rate is increased while all printing occurs during those times when the medium velocity is below the threshold velocity.

In moving picture cinematography, image frames are streamed past a projection aperture at a very fast rate in order to reduce image flicker. However, each frame in succession has to be held stationary while the light source is strobed, whereafter the feed advances quickly to the next frame. While the average feed rate as witnessed by the film spool appears constant, a mechanism known as a film gate freezes each frame briefly and then accelerates the film to the next frame. The film gate together with some sort of buffer arrangement answers a dual requirement to keep the feed rate high while only projecting a frame while stationary.

This concept, in a modified form, can be applied to inkjet printing of either sheet-fed or web printing mediums. A film gate type mechanism or another suitable mechanism for periodically varying a speed of a printing medium relative to one or more groups of inkjet nozzles can be adapted to allow the average web feed rate to exceed threshold velocity, while still ensuring that the actual inkjet printing occurs while the printing medium is moving past the printheads at a relative velocity below the threshold velocity.

FIG. 2 shows a printer 18 according to a simplified embodiment of the invention. In printer 18, a web of a printing medium 20 is supplied from roll 21. Web 20 passes around roller 26 and over rollers 22 and 23. The web feed direction is indicated by arrows 29. Roll 28 takes up the printed web. In some embodiments roll 28 is replaced by a cutting mechanism (not shown) that cuts the printed web into sheets.

Rollers 22 and 23 are joined by a connecting member 24 that is further activated by a mechanism (not shown) to shuttle back and forth in the direction of arrow 25. A page wide inkjet array 27, having a plurality of inkjet nozzles 102, is disposed to print on web 20. When connecting member 24 moves in the same direction as the web feed, the relative velocity of the web passing inkjet array 27 is increased. When connecting member 24 moves in a direction opposite to the web feed the relative velocity of the web passing inkjet array 27 is decreased allowing printing to occur at a reduced relative velocity. A controller 100 is set up to receive image data and control the inkjet nozzles 102 to print in synchronism with the activation of connecting member 24. Controller 100 may also control motion of connecting member 24 along with other functions of the printer such as the printing medium advance rate.

Those skilled in the art will readily appreciate that there are many possible mechanisms that can be constructed to provide the motion required. Furthermore, it should be readily appreciated that the only requirement is to produce relative motion between the inkjet nozzles and the web and that it is possible to hold rollers 22 and 23 stationary and move the inkjet array back and forth to generate the required relative velocity variation. Alternatively, the feed rate of the printing medium may be directly varied to provide the required relative velocity variation. The inkjet nozzles 102 are only activated when the speed of the media passing the printhead is below threshold velocity thus avoiding the distortion of the deposited dots as previously outlined.

A periodic actuation provided to connecting member 24 in FIG. 2 produces a periodic variation in the velocity of the web relative to printhead 27. FIG. 3-A shows a graph of the relative velocity between printing medium 20 and inkjet printing head 27 for a sinusoidal periodic actuation. The instantaneous web velocity ($V_{web}$) 31 varies in a sinusoidal fashion. Printing only occurs when $V_{web}$ is below threshold velocity ($V_{th}$) 33 at point 32. The average web velocity ($V_{ave}$) 30 is higher than $V_{th}$. Advantageously a mechanism can be constructed to produce the truncated sinusoidal motion waveform shown in FIG. 3-B.

The nozzles 102 may be fired during the period of time when $V_{web}$ is below $V_{th}$, shown at 37 allowing a number of dots to be printed in each cycle in the direction of the web advance direction. In the illustrated embodiment, the relative velocity is constant during this period. Again, average web velocity 35 ($V_{ave}$) is maintained at a higher rate than $V_{th}$ speeding up printing while not compromising quality.

For the pure sinusoidal waveform shown in FIG. 3-A, while the nozzles may be fired whenever $V_{web}$ is below $V_{th}$, in practice this requires more complex synchronization since, to achieve high print quality, the variation of the feed velocity must be compensated for. The threshold velocity $V_{th}$ is the limiting relative velocity between printing medium and inkjet nozzles. A relative velocity higher than $V_{th}$ may result in compromised quality.

FIG. 4-A shows a simplified example for the ideal case in which the web can be instantaneously accelerated or decelerated. In this example, $V_{web}$ is at 60 inches/second for 1 second and then instantaneously decelerated to a printing speed of 20 inches/second for 1 second. $V_{ave}$ is 40 inches/second and $V_{th}$ is just above the printing speed of 20 inches/second. In FIG. 4-B, a single row page wide array of inkjet nozzles 50 is depicted along with a section of printed web 51. There are sufficient nozzles in the cross-web direction to achieve the printing resolution required but only a single row in the direction of the web 51. If web 51 is fed according to the waveform shown in FIG. 4-A, the single row of inkjet nozzles 50, in FIG. 4-B, will be able to print shaded areas 52 on the web. To print the full web, as shown in FIG. 4-C, a page wide array of nozzles 60 having 4 rows is required in this example. Note that to address the entire surface of the web, rows of nozzles 60 must be spaced apart by an amount depending on the various relative velocities.

While the embodiment of the invention shown in FIG. 4-B is not able to print the entire web while maintaining an average feed rate in excess of $V_{th}$, this particular embodiment could be advantageous for printing a variable image or text on a previously printed web. A web that has been previously printed on a printing press, such as an offset press or a flexographic press, may require only specific areas of customized printing such as a name field. The timing of the velocity variations may be controlled so that the relative velocity of inkjet nozzles 50 and web 51 is less than $V_{th}$ during those times when nozzles 50 are adjacent a portion of web 51 which should be printed on by nozzles 50.

There is an ever-growing demand for print products that fit special or individual needs of a customer. Personalized print products (e.g. names and/or addresses that vary from print to print in an otherwise fixed print image), and segmented print orders where parts of the print run are modified, are being developed to meet this demand. This type of printing where image or text is filled in or customized on an already printed page or on the fly in a single printing operation is known as variable data printing. An example of this would be the printing of labels for a food product having many different flavours. To save money a common label could be printed cheaply on an offset or flexographic printing press and then customized with the name of each flavour, and possibly a batch or serial number, by an inkjet web printer. Because the inkjet printer is only required to customize the label, full coverage of the web is not necessary. The present invention has an advantage in that it can maintain a fast web feed rate when not printing and only slow down to print the variable data.

The methods of the invention may be applied to periodically slow a web to allow inkjet printing to take place such that variable data may be handled. The web is slowed at times to coincide with times when an area which requires insertion of inkjet printed matter is adjacent an inkjet printhead. The inkjet printhead prints within the area while the relative velocity $V_{web}$ of the medium and the printhead is less than $V_{th}$.

Hybrid printing presses have been described in the art where an offset or flexographic press has an inkjet printing device incorporated to print variable data. Typically, a trade off has to be made between speed and quality. The press may be capable of very high speeds while the inkjet device will have compromised quality at full press speed. Applying the methods of the invention to a hybrid printing press permits increased inkjet printing quality could be provided at higher average web speeds.

The simplified examples of FIGS. 4-A to 4-C discussed above are an idealized description used to facilitate simple explanation of the concepts of the present invention. In practice, an actual velocity waveform will differ from the idealized one shown in FIG. 4A. Those skilled in the art will appreciate that the concepts of the present invention can be applied in a variety of ways to achieve the results described.

While the apparatus and methods of the present invention have been described in relation to a web press and there is particular advantage to their application to such a printing medium it is not mandated. Some of the benefits of the present invention may be realized in a sheet fed printing system where the printing medium is advanced at a varying feed velocity to enable printing at below threshold velocity while still maintaining a high average feed rate.

As will be apparent to those skilled in the art in the light of the foregoing disclosure, many alterations and modifications are possible in the practice of this invention without departing from the spirit or scope thereof.

What is claimed is:

1. A method for printing using one or more inkjet nozzles, the method comprising;

a) feeding a printing medium in a feed direction past the one or more inkjet nozzles at a varying relative velocity between the nozzles and the printing medium, the relative velocity having an average exceeding a threshold velocity and periodically having a value less than the threshold velocity;

b) selectively activating the one or more inkjet nozzles in response to data supplied by a controller only while the relative velocity is below the threshold velocity.

2. A method according to claim 1 comprising alternating the relative velocity between:

a) a first velocity higher than the threshold velocity; and b) a second velocity lower than the threshold velocity.

3. A method according to claim 2 wherein the printing medium is periodically stationary.

4. A method according to claim 3 comprising traversing the one or more inkjet nozzles across the printing medium in a direction generally perpendicular to the feed direction and selectively activating the one or more inkjet nozzles only while the printing medium is stationary.

5. A method according to claim 1 wherein the feeding of the printing medium is varied to establish the varying relative velocity.

6. The method according to claim 1 comprising reciprocating the one or more inkjet nozzles back and forth in a direction of the feeding of the printing medium.

7. A method according to claim 6 wherein the printing medium is fed at a substantially constant velocity past the reciprocating inkjet nozzles.

8. The method according to claim 1 wherein a rate of the feeding of the printing medium is varied and the one or more inkjet nozzles are reciprocated in the direction of the feeding of the printing medium.

9. A method according to claim 1 wherein the inkjet nozzles are arranged in a plurality of arrays spaced apart in the feed direction and the method comprises operating inkjet nozzles of each of the arrays only while the relative velocity is below the threshold velocity.

10. A method according to claim 9 wherein, during times while the relative velocity is less than the threshold velocity, each of the arrays sweeps out an area of the printing medium, and the areas swept by the arrays substantially cover the printing medium.

11. A method according to claim 9 wherein the arrays comprise page wide arrays.

12. The method according to claim 1 wherein the printing medium is a continuous web medium.

13. The method according to claim 1 wherein the printing medium is supplied as one or more separate sheets.

14. The method according to claim 1 wherein the one or more inkjet nozzles form a page wide array.

15. The method according to claim 1 wherein the printing medium has been previously printed in a separate process and the inkjet nozzles print only at specific locations on the printing medium.

16. The method according to claim 15 wherein the inkjet nozzles print variable data at the specific locations.

17. A method according to claim 1 wherein the relative velocity varies with time according to a truncated sinusoidal waveform.

18. An inkjet printing apparatus comprising;

a) one or more inkjet printing nozzles disposed to eject ink droplets on a printing medium;

b) a feed for advancing the printing medium past the nozzles at a variable relative velocity between the nozzles and the printing medium, the relative velocity alternating between:

i) a first velocity higher than the threshold velocity; and ii) a second velocity lower than the threshold velocity;

c) a controller for selectively activating the nozzles when the relative velocity is lower than the threshold velocity.

19. The apparatus of claim 18 incorporated in one of:

a) an offset press;

b) a flexographic press;

c) a gravure press;

d) a toner based press;

e) an inkjet press;

for printing variable data on a printing medium.

* * * * *